US005486122A

United States Patent [19]

Oda et al.

[11] Patent Number: 5,486,122

[45] Date of Patent: Jan. 23, 1996

[54] BOLT-TIGHTENED CONNECTOR

[75] Inventors: Kenzo Oda, Hatano; Shinji Amemiya, Kanagawa, both of Japan

[73] Assignee: The Whitaker Corporation, Wilmington, Del.

[21] Appl. No.: 95,384

[22] Filed: Jul. 21, 1993

[30] Foreign Application Priority Data

Aug. 21, 1992 [JP] Japan ..... 4-058841 U

[51] Int. Cl.[6] ..... H01R 13/514

[52] U.S. Cl. ..... 439/752; 439/364

[58] Field of Search ..... 439/362, 364, 439/595, 752

[56] References Cited

U.S. PATENT DOCUMENTS

| | | | |
|---|---|---|---|
| 4,867,712 | 9/1989 | Kato et al. | 439/752 |
| 5,066,252 | 11/1991 | Kato et al. | 439/752 |
| 5,201,625 | 4/1993 | Takenouchi et al. | 439/364 X |
| 5,299,958 | 4/1994 | Ohsumi | 439/752 |

FOREIGN PATENT DOCUMENTS

| | | |
|---|---|---|
| 1-43986 | 6/1984 | Japan . |
| 1-64872 | 4/1989 | Japan . |
| 1050889 | 12/1966 | United Kingdom . |
| 2141594 | 12/1984 | United Kingdom . |
| 2208497 | 5/1989 | United Kingdom . |
| 2248350 | 1/1992 | United Kingdom . |

*Primary Examiner*—David L. Pirlot
*Assistant Examiner*—Daniel Wittels
*Attorney, Agent, or Firm*—Adrian J. LaRue; Timothy J. Aberle

[57] ABSTRACT

When double-lock member (42*a*) is in an incompletely inserted state, the contacting part (43*a*) projects from the plug housing (20). In this incompletely inserted state, the plug housing (20) and cap housing (30) are in a position prior to being tentatively latched to each other, and the contacting part (43*a*) of the double-lock member (42*a*), which has not been inserted into the plug housing (20), makes contact with the end (30*a*) of the cap housing (30), so the drawing together of the plug housing (20) and the cap housing (30) cannot proceed. Also, the end of the bolt case (14) in which the bolt (12) is clasped into the hole (22) of the plug housing, and the bolt (12) is held in the plug housing (20) by the bolt stop plate (40). Therefore, the bolt (12) is held in an unengaged state in the when in the incompletely inserted state.

34 Claims, 4 Drawing Sheets

FIG. 2
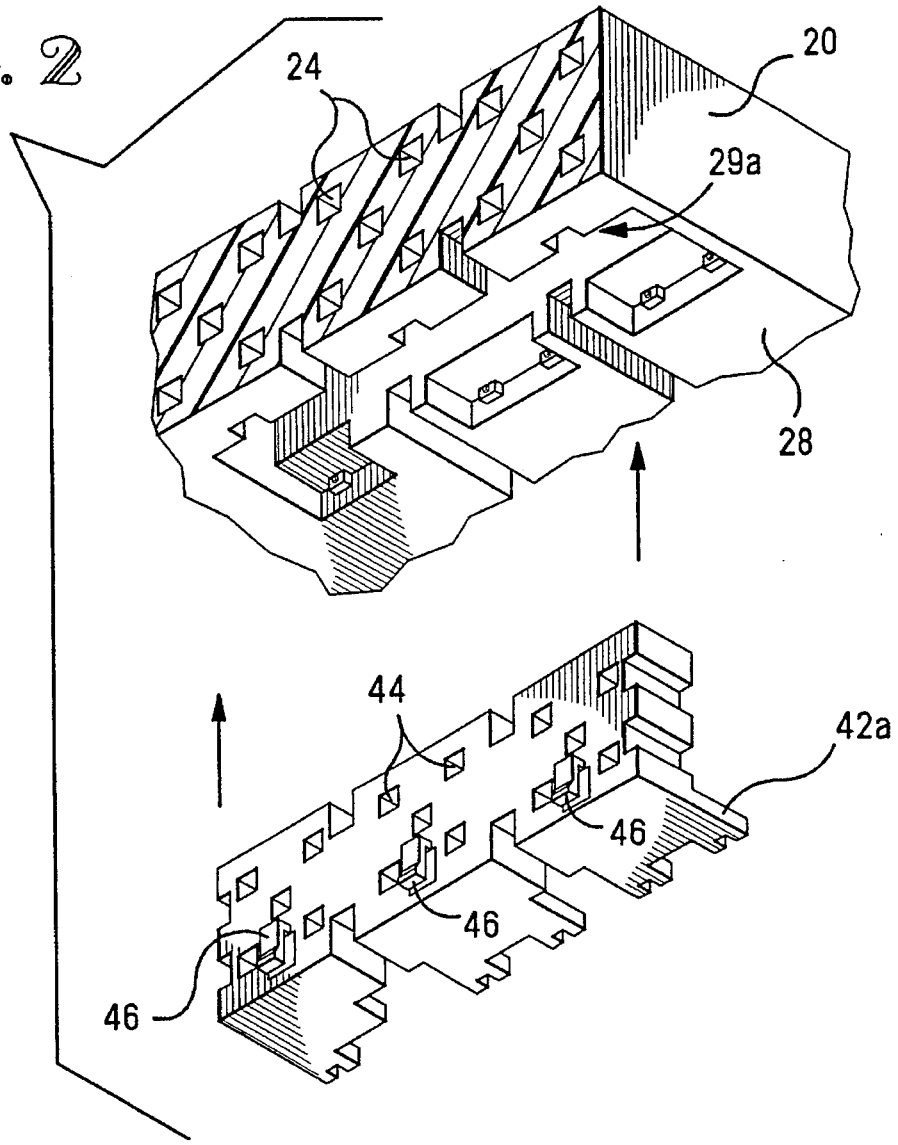
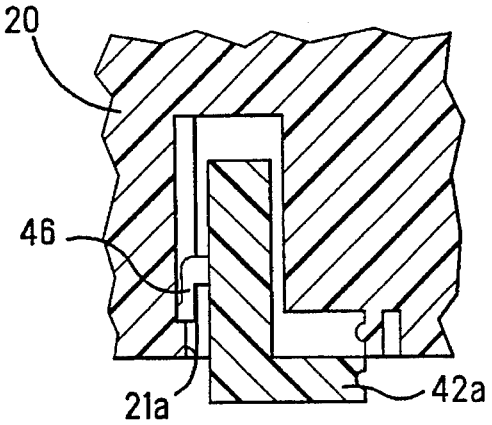
FIG. 3
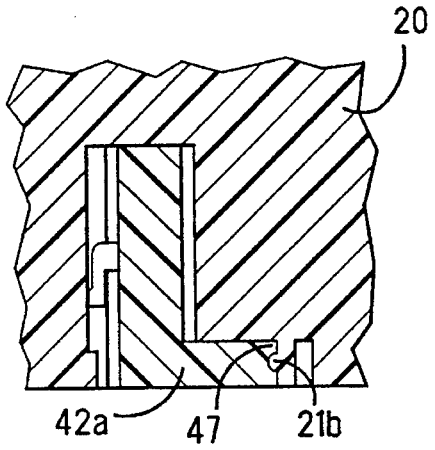
FIG. 4

BOLT-TIGHTENED CONNECTOR

The present device relates to a bolt-tightened electrical connector.

BACKGROUND OF THE INVENTION

Connectors that doubly latch electrical contacts by means of a housing lance that extends from an inside wall of an insulating housing to a contact compartment (i.e., the primary latching means), and a double-lock member formed separately from the insulating housing (i.e., the secondary latching means), in order to ensure latching of the contacts inside the insulating housing of the connector are known. Examples of such a double-lock member include one that latches the rear end of the electrical wire-connecting part of the contacts (see Japanese Patent Publication 1-43986), and one that reinforces the latching by the housing lance with engagement between the housing lance and the insulated housing inner wall (see Japanese Patent Application 1-64872).

A bolt-tightened connector that has a bolt in either of a pair of connector housings that fit together and has a nut that screw-meshes with the bolt in the other connector housing is also known. However, a bolt-tightened connector with a double-lock member has not been known heretofore.

A bolt-tightened connector with a double-lock member can be produced by attaching the conventional double-lock member described above to the conventional bolt-tightened connector described above. However, if the pair of connector housings were tentatively latched and the bolt and nut were in a state in which they could screw-mesh, a strong force was needed to screw-mesh the bolt and nut even when the double-lock member was incompletely inserted. Therefore, there was a risk that the pair of connector housings would be forcibly fitted together by this screw-meshing, resulting in damage to the double-lock member of connector housings. Additionally, even if the connector housings were fitted together, the double-lock member was incompletely inserted and so there was a risk that the contacts would drop out.

In view of the above situation, the objective of this device is to provide a bolt-tightened connector that places the bolt in an unengaged state, not screw-meshed with the nut, when the double-lock member is incompletely inserted.

SUMMARY OF THE INVENTION

The bolt-tightened connector of the instant invention is a bolt-tightened connector that has a bolt in either one of a first connector housing and a second connector housing, which fit together and in which the respective contacts are accommodated. The invention further includes a nut that screw-meshes with the bolt in the other connector housing. The invention is characterized by the fact that it has a double-lock member which is inserted inside the first connector housing from a side wall that widens in the fitting direction of the first connector housing, and which latches the contacts accommodated in the first connector housing. Furthermore, the double-lock member has a contacting part that projects from the side wall in the incompletely inserted state and makes contact with the second connector housing before the bolt and nut, which are in the process of fitting together the first and second connector housings.

When the double-lock member of the bolt-tightened connector of the instant device is in an incompletely inserted state, the contacting part of the double-lock member and the second connector housing make contact in the course of fitting together the first and second connector housings. Therefore, the bolt is kept in an unengaged state and the drawing together of the connector housings cannot further proceed. That is, if the double-lock member is in an incompletely inserted state, the bolt and nut cannot be screwed together and thus complete fitting together is not effected. Therefore, destruction of the double-lock member or connector housings is prevented.

However, when completely fitted together, the double-lock member is in a completely inserted state, and therefore the connectors are prevented from separating.

BRIEF DESCRIPTION OF THE DRAWINGS

FIG. 2 is a partially enlarged view showing a part of the bolt-tightened connector shown in FIG. 1 at the cross-section, as viewed from below.

FIG. 3 is a partial cross-section showing the double-lock member tentatively latched to the plug housing.

FIG. 4 is a partial cross-section showing the double-lock member fully latched to the plug housing.

DETAILED DESCRIPTION OF THE PREFERRED EMBODIMENTS

Figure 1:
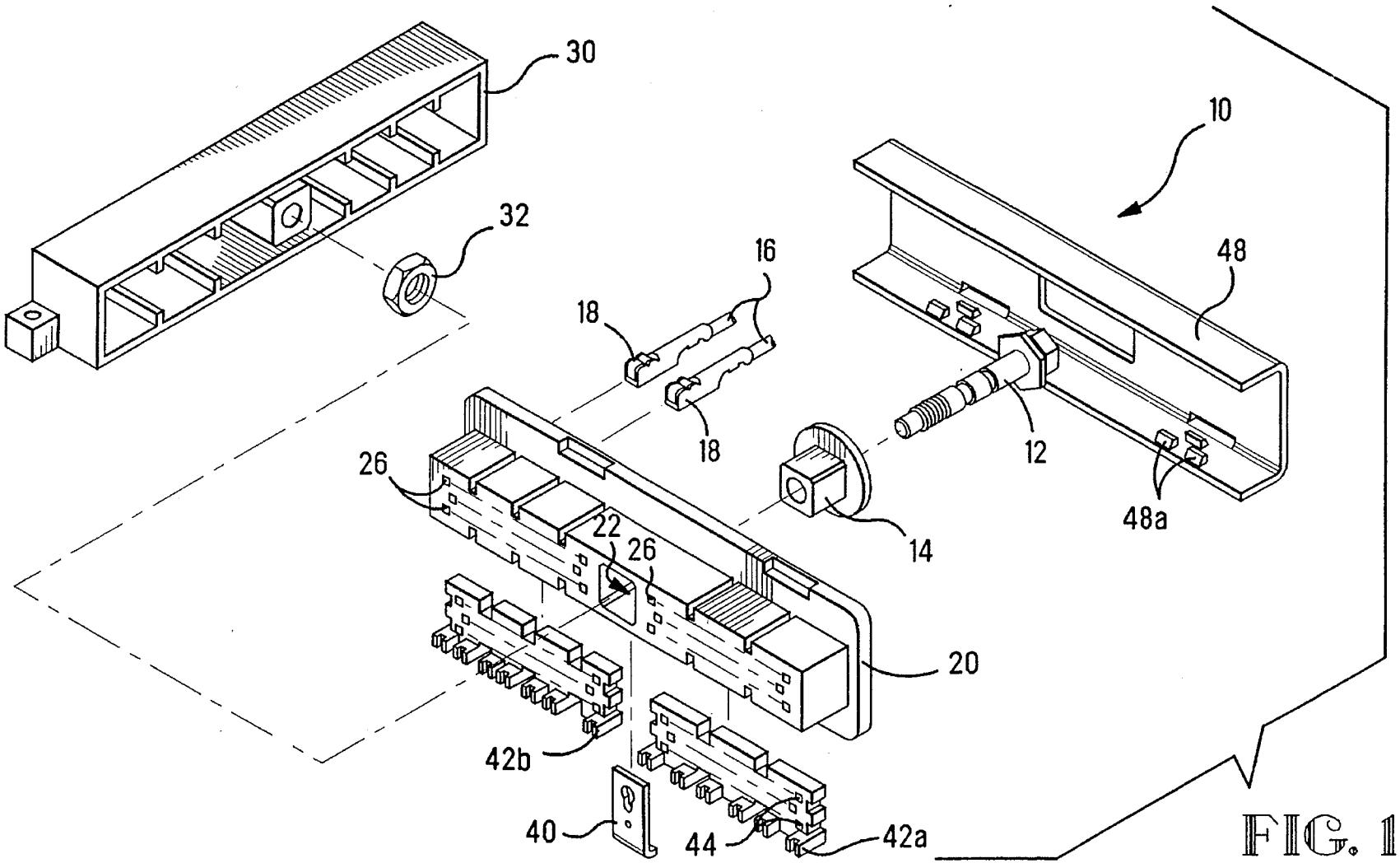
FIG. 1 is an exploded, oblique view showing the bolt-tightened connector of one practical embodiment of the instant invention.

FIG. 1 is a oblique exploded view of a practical embodiment showing the bolt-tightened connector. FIG. 2 is a partial, enlarged view showing part of the bolt-tightened connector shown in FIG. 1 at the cross-section as viewed from below.

The bolt-tightened connector 10 has a plug housing 20 and cap housing 30 which fit together. In the center of the plug housing 20, there is formed a hole 22 into which is inserted the side of the bolt case 14 which clasps the bolt 12 (see FIG. 7). There are also formed in the plug housing 20 a multiplicity of contact compartments 24 in which a multiplicity of contacts 18, to which electrical wires 16 are pressure bonded, are accommodated (only the contact-insertion holes 26 are shown in FIG. 1). Also, in the side wall 28 on the bottom side of the plug housing 20, there is formed an opening (not shown) into which is inserted a bolt stopper plate 40 that holds the bolt 12. In addition, two openings 29*a* for inserting the two double-lock members 42*a*, 42*b* (the opening that accommodates the double-lock member 42*b* is not shown) are formed which extend across the multiplicity of contact compartments 24.

The double-lock members 42*a* and 42*b* are usually formed from a synthetic resin. Also, a multiplicity of contact-insertion holes 44 are formed in each double-lock member 42*a* and 42*b*. The contact-insertion holes 44 connect with the contact compartments 24 of the plug housing 20 in the tentatively latched state of the double-lock members 42*a* and 42*b*, which will be discussed later. In addition, a multiplicity of tentative, resiliently deflectable latching arms 46 that engage with the convex part 21*a* (see FIG. 3) formed on the inner wall of the opening 29*a* and tentatively latch the double-lock member 42*a* to the plug housing 20 are formed on the double-lock member 42*a*. The electrical wires 16 are protected by a wire cover 48, which is fixed to the plug housing 20 by engagement of the convex parts 48*a* of the wire cover 48 with the concave parts (not shown) of the plug housing 20. Also, a nut 32 that screw-meshes with the bolt 12 is installed in the cap housing 30.

Next, the situation of the double-lock member inserted in the plug housing will be explained by referring to FIG. 3 and FIG. 4. The bolt-tightened connector 10 has two double-lock members 42*a* and 42*b*, as shown in FIG. 1. These differ somewhat in shape, but their actions are the same, so only double-lock member 42*a* will be explained in FIG. 3 and 4.

FIG. 3 is a partial cross-section that shows the double-lock member 42*a* tentatively latched to the plug housing 20. FIG. 4 is a partial cross-section that shows the double-lock member 42*a* fully latched to the plug housing 20.

As shown in FIG. 3, the double-lock member 42*a*, when inserted into the plug housing 20, is tentatively latched to the plug housing 20 by the tentative, resilient latching arm 46 which deflects when sliding over the bump 21*a* provided on the inside wall of the opening 29*a*, and after assuming its undeflected state cannot come loose from the plug housing 20. This tentative latching state is the incompletely inserted state. By further inserting the double-lock member 42*a* from this incompletely inserted state, the full latching part 47 is engaged in the bump 21*b* of the plug housing 20, whereby the double-lock member 42*a* is fully latched to the plug housing 20 and is in the completely inserted state.

Next, the positional relations of the double-lock member and contact housing compartments when the double-lock member is tentatively latched to the plug housing will be explained by referring to FIG. 5.

Figure 5:
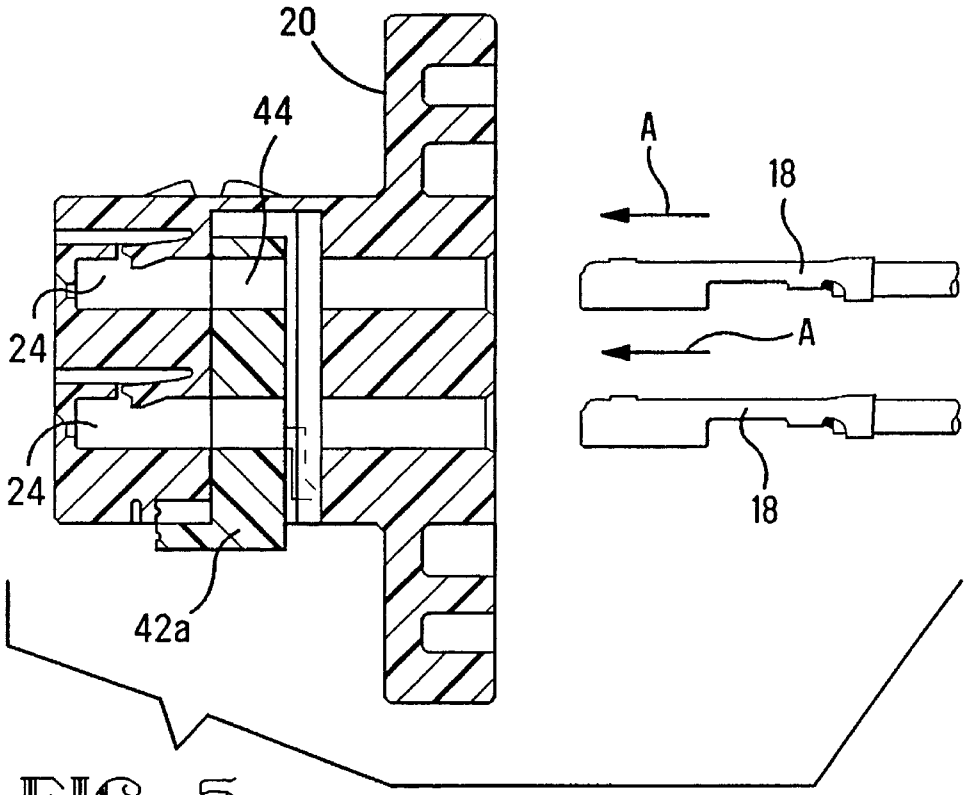
FIG. 5 is a partial cross-section showing the positional relations of the double-lock member and the contacts when the double-lock member is tentatively latched to the plug housing.

FIG. 5 is a partial cross-section that shows the positional relations of the double-lock member and the contact compartments when the double-lock member is tentatively latched to the plug housing.

In this tentative latching state, the contact-insertion holes 44 of the double-lock member 42*b* connect with the contact compartments 24 of the plug housing 20, so the contacts 18 are completely accommodated in the contact compartment 24 by inserting the contacts 18 in the direction of the arrows A.

Figure 6:
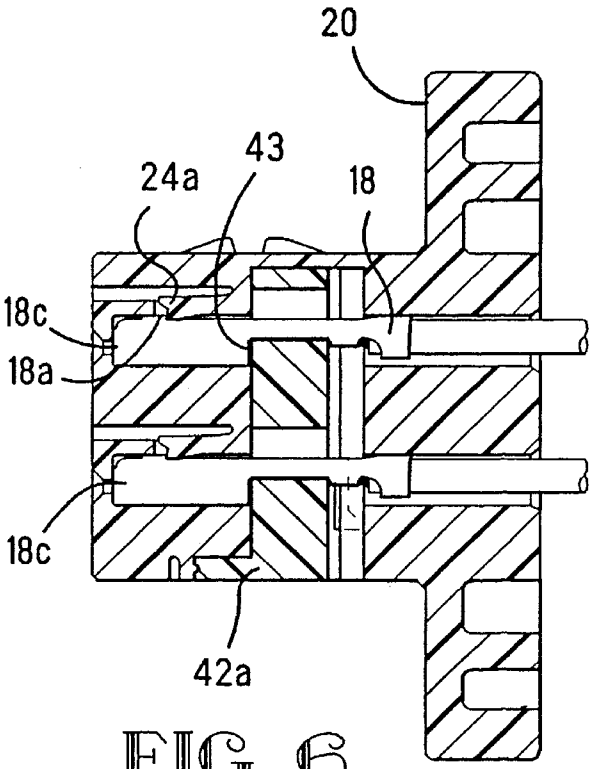
FIG. 6 is a partial cross section showing the positional relations of the double-lock member and the contacts when the double lock member is fully latched to the plug housing.

FIG. 6 is a partial cross-section that shows the positional relations of the double-lock member and the contacts when the double-lock member is fully latched to the plug housing.

In this fully latched state, the bump 18*a* of the contact is engaged with the housing lance 24*a* formed in the inside wall of the contact compartment 24*a*, and the engaging part 43 of the double-lock member 42*a* is engaged with the rear end of the contact part 18*c* of the contact 18. Therefore, contact 18 is doubly latched. As a result, the contacts 18 are reliably prevented from slipping out in the direction of separation.

Figure 7:
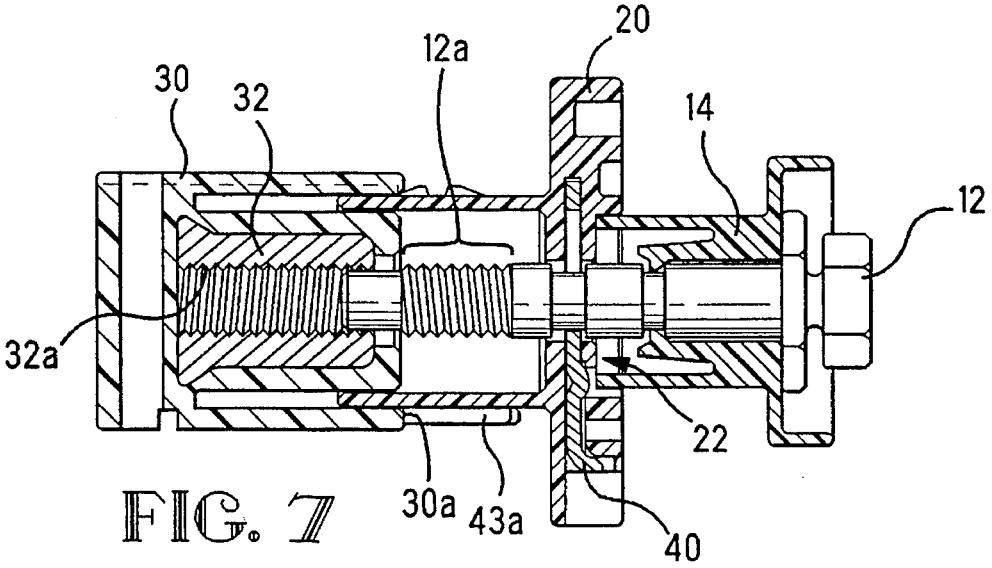
FIG. 7 is a partial cross-section showing the positional relations of the bolt and nut in the course of fitting the plug housing and cap housing together with the double-lock member tentatively latched to the plug housing (i.e., the completely inserted state).

FIG. 7 is a partial cross-section that shows the positional relations of the bolt and nut in the course of fitting the plug housing and the cap housing together in the state where the double-lock member is tentatively latched to the plug housing (i.e., the incompletely inserted state).

The double-lock member 42*a* leaves behind the contacting part 43*a* and is inserted inside the plug housing 20, entering the tentative latching state (see FIG. 3). When the plug housing 20 and the cap housing 30 are fitted together while this double-lock member 42*a* is in the tentative latching state, the contacting part 43*a* of the double-lock member 42*a* that sticks out from the plug housing 20 makes contact with the end 30*a* of the cap housing 30, so the fitting together of the plug housing 20 and the cap housing 30 cannot be advanced. As a result, the plug housing 20 and the cap housing 30 cannot tentatively latch. Also, the side part of the bolt case 14 that clasps the bolt 12 is inserted into the hole 22 of the plug housing 20, and the bolt 12 is held in the plug housing 20 by the bolt stop plate 40. For that reason, the threaded screw part 12*a* of the bolt 12 cannot screw-mesh with the screw part 32*a* of the nut 32, and the bolt 12 is held in an unengaged state.

Figure 8:
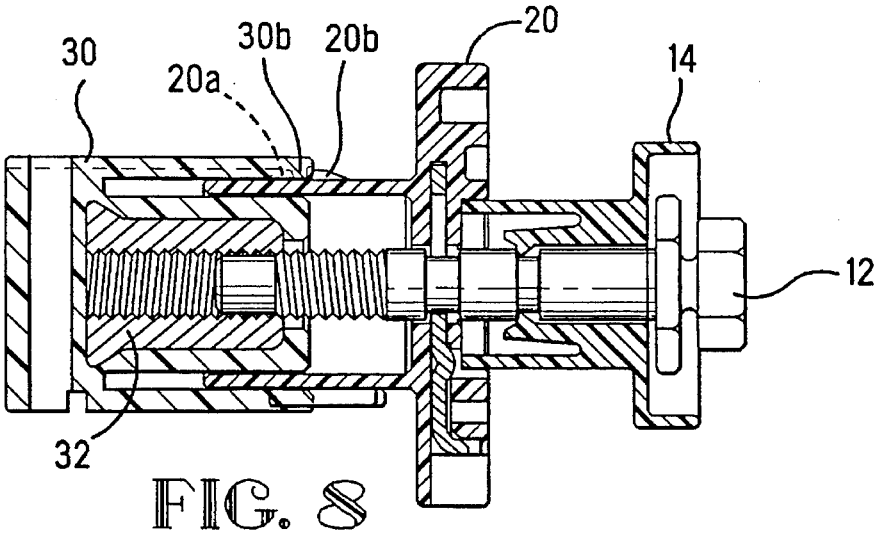
FIG. 8 is a partial cross-section showing the positional relations of the bolt and nut in the course of fitting the plug housing and cap housing together with the double-lock member fully latched to the plug housing (i.e., the completely inserted state).

FIG. 8 is a partial cross-section that shows the positional relations of the bolt and nut when the plug housing and cap housing have been tentatively latched together with the double-lock member fully latched to the plug housing (i.e., the completely inserted state).

The double-lock member 42*a* (see FIG. 4) is completely inserted inside the plug housing 20 and in the fully latched state (see FIG. 4). In this fully latched state of the double-lock member 42*a*, the plug housing 20 and cap housing 30 become tentatively latched by advancing the plug housing 20 and cap housing 30 in the fitting direction and fitting the convex part 30*b* of the cap housing 30 between a bump 20*a*, formed on the plug housing 20, and a bump 20*b*, for preventing an advance in fitting together. Also, the tip of the threaded part of the bolt 12 and the tip of the threaded part of the nut 32 are in a state of relationship immediately prior to screw-meshing.

Figure 9:
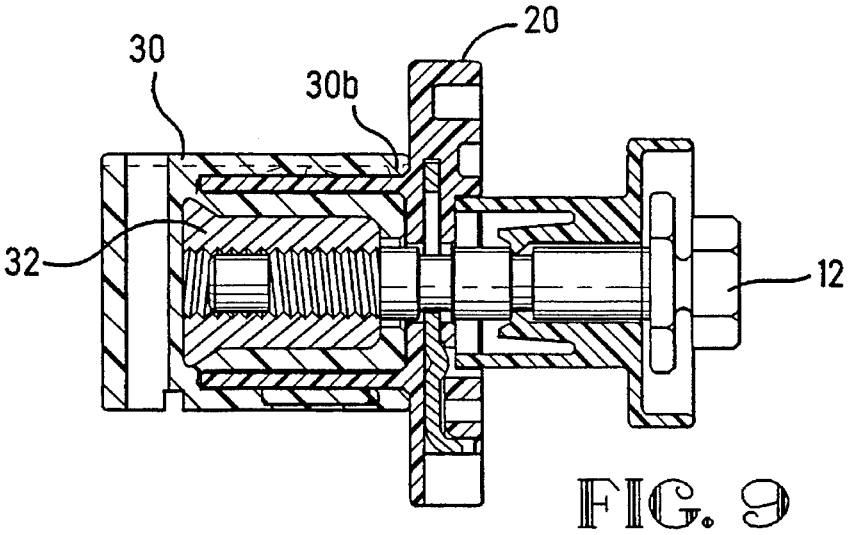
FIG. 9 is a partial cross-section showing the plug housing and cap housing completely fitted together.

FIG. 9 is a partial cross-section that shows the state in which the plug housing and cap housing are completely fitted together.

In the state in which the double-lock member is fully latched to the plug housing as shown in FIG. 8, the bolt 12 and nut 32 begin to screw-mesh by the bolt 12 being turned with an air driver, etc. The vicinity of the convex part 30*b* of the cap housing 30 flexes as it passes over the bump 20*b* and the plug housing 20 and cap housing 30 become completely fitted together.

When the double-lock member is in the incompletely inserted state in the case of the bolt-tightened connector of the foregoing practical embodiment, the contacting part of the double-lock member that sticks out from the plug housing comes into contact with the cap housing, so the plug housing and cap housing cannot be advanced in the direction of fitting together. Therefore, the bolt is held in an unengaged state, and in the incompletely inserted state of the double-lock member, the bolt and nut cannot screw-mesh, and the fitting together of the plug housing and the cap housing is not carried out. Therefore, destruction of the double-lock member or plug housing is prevented. Also, the plug housing and cap housing are not fitted together with the double-lock member in the incompletely inserted state, so separation of the contacts due to insufficient double-locking of those contacts when the plug housing and cap housing were fitted together is prevented.

We claim:

1. An electrical connector half comprising:

a plug housing having apertures for receiving contacts, and which is matable to a cap housing;

the plug housing includes at least one opening for receiving a two-position double-lock member, the opening including at least one projection for engaging and retaining the double-lock member in a tentatively latched first position or a fully latched second position; and the cap housing is fitted to the plug housing by the cap housing covering the double-lock member when the double-lock member is in the fully latched second position wherein the double-lock member includes a resiliently deflectable latching arm which deflects in response to engaging said at least one projection as the double-lock member is moved to said first position.

2. The electrical connector of claim 1, wherein the double-lock member and the housing include at least one bump and groove structural arrangement for maintaining the double-lock member in the second position.

3. The electrical connector of claim 1, wherein the cap housing is stopped from being completely fitted to the plug housing by the cap housing engaging the double-lock member when the double-lock member is in the first position.

4. The electrical connector of claim 1, wherein the cap housing is stopped from being completely fitted to the plug housing by the cap housing engaging the double-lock member when the double-lock member is in the first position;

and wherein a cap housing convex part is disposed between a pair of bumps on the top surface of the plug housing.

5. The electrical connector of claim 1, wherein a convex part of the cap housing is cammed upwardly when the cap housing is fitted to the plug housing by covering the double-lock member when the double-lock member is in the fully latched second position.

6. The electrical connector of claim 1, wherein a convex part of the cap housing is cammed upwardly as the cap housing is fitted to the plug housing.

7. An electrical connector comprising:

a plug housing having apertures for receiving contacts, and an aperture for receiving a first fastening means;

a cap housing having a second fastening means for engaging said first fastening means when the cap housing is joined to the plug housing;

the plug housing includes at least one opening for receiving a two-position double-lock member, the opening including at least one projection for engaging and retaining the double-lock member in a tentatively latched first position or a fully latched second position; and the cap housing is fitted to the plug housing by the cap housing covering the double-lock member when the double-lock member is in the fully latched second position and wherein the double-lock member includes a resiliently deflectable latching arm which deflects in response to engaging said at least one projection as the double-lock member is moved to said first position.

8. The electrical connector of claim 7, wherein the double-lock member is provided with a latching arm for positioning the double-lock member in the first position.

9. The electrical connector of claim 7, wherein the double-lock member and the housing include at least one bump and groove structural arrangement for maintaining the double-lock member in the second position.

10. The electrical connector of claim 7, wherein the cap housing is stopped from being completely fitted to the plug housing by the cap housing engaging the double-lock member when the double-lock member is in the first position.

11. The electrical connector of claim 7, wherein the cap housing is stopped from being completely fitted to the plug housing by the cap housing engaging the double-lock member when the double-lock member is in the first position;

and wherein a cap housing convex part is disposed between a pair of bumps on the top surface of the plug housing.

12. The electrical connector of claim 7, wherein a convex part of the cap housing is cammed upwardly when the cap housing is fitted to the plug housing by covering the double-lock member when the double-lock member is in the fully latched second position.

13. The electrical connector of claim 7, wherein a convex part of the cap housing is cammed upwardly as the cap housing is fitted to the plug housing.

14. An electrical connector comprising:

a plug housing having apertures for receiving contacts, and an aperture for receiving a first fastening means;

a cap housing having a second fastening means for engaging said first fastening means when the cap housing is joined to the plug housing;

wherein the plug housing includes at least one opening for receiving a two-position double-lock member, the opening including at least one projection for engaging and retaining the double-lock member in a tentatively latched first position or a fully latched second position;

and wherein the cap housing is stopped from being completely fitted to the plug housing by the cap housing engaging the double-lock member when the double-lock member is in the first position.

15. The electrical connector of claim 14, wherein the double-lock member is provided with a latching arm for positioning the double-lock member in the first position.

16. The electrical connector of claim 14, wherein the double-lock member and the housing include at least one bump and groove structural arrangement for maintaining the double-lock member in the second position.

17. The electrical connector of claim 14, wherein the cap housing is stopped from being completely fitted to the plug housing by the cap housing engaging the double-lock member when the double-lock member is in the first position;

and wherein a cap housing convex part is disposed between a pair of bumps on the top surface of the plug housing.

18. The electrical connector of claim 14, wherein the cap housing is fitted to the plug housing by the cap housing covering the double-lock member when the double-lock member is in the fully latched second position.

19. The electrical connector of claim 14, wherein a convex part of the cap housing is cammed upwardly when the cap housing is fitted to the plug housing by covering the double-lock member when the double-lock member is in the fully latched second position.

20. The electrical connector of claim 14, wherein a convex part of the cap housing is cammed upwardly as the cap housing is fitted to the plug housing.

21. An electrical connector comprising:

a plug housing having apertures for receiving contacts, and an aperture for receiving a first fastening means;

a cap housing having a second fastening means for engaging said first fastening means when the cap housing is joined to the plug housing;

wherein the plug housing includes at least one opening for receiving a two-position double-lock member, the opening including at least one projection for engaging and retaining the double-lock member in a tentatively latched first position or a fully latched second position;

and wherein a convex part of the cap housing is cammed upwardly as the cap housing is fitted to the plug housing.

22. The electrical connector of claim 21, wherein the double-lock member is provided with a latching arm for positioning the double-lock member in the first position.

23. The electrical connector of claim 21, wherein the double-lock member and the housing include at least one bump and groove structural arrangement for maintaining the double-lock member in the second position.

24. The electrical connector of claim 21, wherein the cap housing is stopped from being completely fitted to the plug housing by the cap housing engaging the double-lock member when the double-lock member is in the first position.

25. The electrical connector of claim 21, wherein the cap housing is stopped from being completely fitted to the plug housing by the cap housing engaging the double-lock member when the double-lock member is in the first position;

and wherein a cap housing convex part is disposed between a pair of bumps on the top surface of the plug housing.

26. The electrical connector of claim 21, wherein the cap housing is fitted to the plug housing by the cap housing covering the double-lock member when the double-lock member is in the fully latched second position.

27. The electrical connector of claim 21, wherein a convex part of the cap housing is cammed upwardly when the cap housing is fitted to the plug housing by covering the double-lock member when the double-lock member is in the fully latched second position.

28. An electrical connector comprising:

a cap housing and a plug housing having contact apertures for receiving contacts, said plug housing is matable to said cap housing;

the plug housing includes at least one opening for receiving a two-position double-lock member, said opening comprising a first cavity which intersects at least one contact aperture, and a second cavity which extends generally parallel to a longitudinal axis of the at least one contact aperture; and the opening includes at least one projection for engaging and retaining the double-lock member in a tentatively latched first position or a fully latched second position.

29. The electrical connector of claim 28, wherein the cap housing is fitted to the plug housing by the cap housing covering the double-lock member when the double-lock member is in the fully latched second position.

30. The electrical connector of claim 28, wherein a first projection is disposed in said first cavity for latching said double-lock member in said tentatively latched first position.

31. The electrical connector of claim 28, wherein a second projection is disposed in said second cavity for latching said double-lock member in said fully latched second position.

32. The electrical connector of claim 28, wherein said double-lock member comprises a general L-shape in cross-section.

33. The electrical connector of claim 32, wherein said double-lock member comprises a foot, for disposition in said second cavity, and a leg, for disposition in said first cavity, when said double-lock member is disposed in said second position.

34. The electrical connector of claim 28, wherein said first and second cavities define a generally L-shaped chamber for receiving said double-lock member.

* * * * *